United States Patent [19]

Beekmans

[11] 4,220,890

[45] Sep. 2, 1980

[54] MAGNETIC SHIELDING FOR AN X-RAY IMAGE INTENSIFIER TUBE

[75] Inventor: Antonius A. G. Beekmans, Eindhoven, Netherlands

[73] Assignee: U.S. Philips Corporation, New York, N.Y.

[21] Appl. No.: 883,132

[22] Filed: Mar. 3, 1978

[30] Foreign Application Priority Data

Mar. 28, 1977 [NL] Netherlands ..... 7703296

[51] Int. Cl.[2] ..... H01J 1/53

[52] U.S. Cl. ..... 313/240; 250/213 VT; 313/242; 313/102; 315/8; 315/85

[58] Field of Search ..... 313/239, 240, 241, 242, 313/102, 313; 315/8, 85; 250/213 VT

[56] References Cited

U.S. PATENT DOCUMENTS

| | | | |
|---|---|---|---|
| 2,727,173 | 12/1955 | Longini et al. | 313/313 X |
| 3,119,037 | 1/1964 | Stanley | 313/102 X |
| 3,331,979 | 7/1967 | Sybeldon et al. | 313/242 X |
| 3,377,504 | 4/1968 | Rebicek | 315/85 |
| 3,688,146 | 8/1972 | Bouwers | 313/313 |
| 3,858,050 | 12/1974 | Carlson | 313/313 |
| 3,889,144 | 6/1975 | McGee | 313/102 |
| 4,000,432 | 12/1976 | Coon et al. | 313/239 |

*Primary Examiner*—Saxfield Chatmon, Jr.
*Attorney, Agent, or Firm*—Marc D. Schechter

[57] ABSTRACT

An image-forming device, comprising an image intensifier tube, includes a magnetic shielding grid comprising a ferromagnetic material, which is arranged near the entrance screen of the image intensifier tube for the purpose of shielding against disturbing magnetic fields. Due to the use of partly radiation absorbing material and partly ferromagnetic material this shielding grid can replace, a stray radiation grid already present in the device, or can be added as a grid with radiation transmitting material and ferromagnetic material without the image formation being disturbed in any way.

18 Claims, 1 Drawing Figure

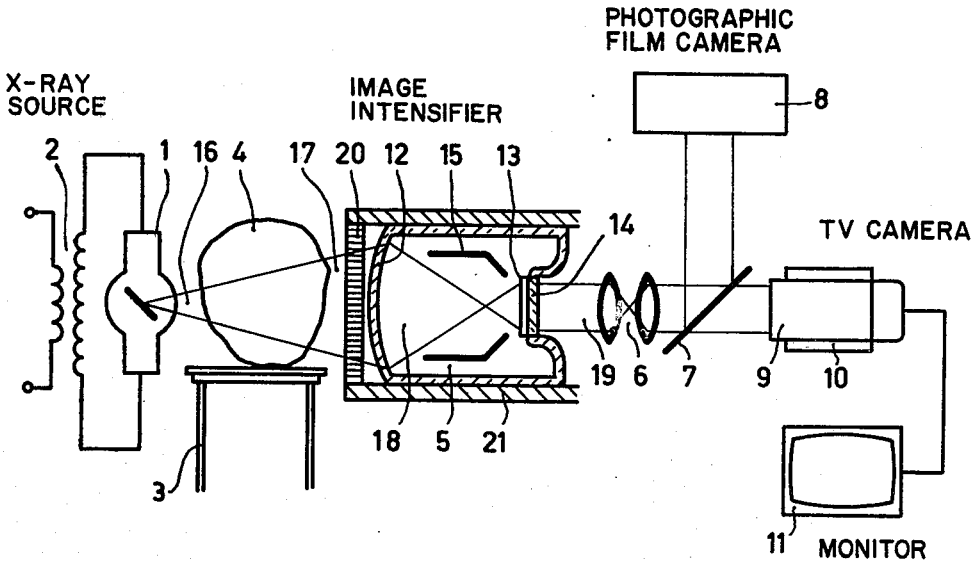
PHOTOGRAPHIC
FILM CAMERA
X-RAY
SOURCE
IMAGE
INTENSIFIER
TV CAMERA
MONITOR
2
1
16
4
17
20
12
15
13
14
8
19
6
7
9
10
18
5
21
3
11

MAGNETIC SHIELDING FOR AN X-RAY IMAGE INTENSIFIER TUBE

BACKGROUND OF THE INVENTION

The invention relates to an image-forming device, comprising an image intensifier tube.

Devices of this kind are used, for example, in medical X-ray apparatus, scintigraphy and X-ray analysis apparatus. In such devices, an image-carrying radiation beam, for example a beam of X-radiation or gamma radiation, is incident on an entrance screen of an image intensifier tube. In the entrance screen of the image intensifier tube, the image-carrying radiation is converted into an image-carrying beam of photoelectrons. The electron beam is imaged on a luminescent exit screen of the image intensifier tube by means of an electron optical system included in the tube. A problem is encountered in that the quality of the electron optical imaging in the image intensifier tube is adversely affected by external magnetic fields. Examples of disturbing magnetic fields are the terrestrial magnetic field and magnetic fields originating from deflection coils, power supply equipment for the radiation source, electrically driven motors, magnetic braking devices etc..

German Offenlegungsscrift No. 2306575 (Schiegel 14–8–1974) describes an X-ray image intensifier tube comprising a ferromagnetic foil which is arranged in front of the entrance screen. This foil is magnetically integral with a cylinder of ferromagnetic material which is arranged around the image intensifier tube. The object of incorporating these ferromagnetic structures in the tube is to reduce the effect of distributing magnetic fields. However, there are drawbacks to using the above-described foils. Besides absorbing stray radiation, such a foil will also absorb part of the image-forming radiation. The foil moreover causes additional dispersion in the image-forming beam. A reduction of these effects by choosing the foil to be comparatively thin, has the drawback that the magnetic shielding is then insufficient.

SUMMARY OF THE INVENTION

An object of the invention is to provide a device in which suitable magnetic shielding is ensured, while minimizing the absorption and dispersion of the image-carrying radiation. To this end, an image forming device of the described kind in accordance with the invention is characterized in that a magnetic shielding material is included in a grid which is arranged near an entrance screen of the image intensifier tube. Because the shielding material is arranged in the form of a grid in accordance with the invention, no substantial absorption or dispersion of the image-carrying radiation beam occurs, but still a comparatively large quantity of magnetic shielding material can be present in front of the entrance screen, so that ample shielding is ensured.

In a preferred embodiment according to the invention, a stray radiation grid, comprising laminations of a ferromagnetic material, is provided forming a closed magnetic cylinder surrounding the image intensifier tube.

In a further preferred embodiment, the laminations of the stray radiation grid consist partly of a commonly used grid material, such as lead, and partly of ferromagnetic material such as, for example, mu-metal. Both requirements to be imposed, namely adequate magnetic shielding and adequate collimation, can be optimally satisfied by a suitable choice of the material ratios and the geometry, without the addition of an additional grid.

A stray radiation grid in accordance with the invention may be constructed, as described, to be integral with the image intensifier tube, or to be a detachable independent element. In a further preferred embodiment according to the the invention, the magnetic shielding material forms part of an element included in the image intensifier tube. For example ferro-magnetic material may be included in the channel amplifier plate of an image intensifier tube having such a plate.

Some preferred embodiments according to the invention will be described in detail hereinafter with reference to the accompanying drawings.

BRIEF DESCRIPTION OF THE DRAWING

The drawing diagrammatically shows an image forming device according to the invention, in particular an X-ray examining device.

DESCRIPTION OF THE PREFERRED EMBODIMENTS

The drawing shows the following parts of an X-ray examining device: an X-ray source 1, with a high voltage power supply 2, a patient table 3 for a patient 4 to be examined, an X-ray image intensifier tube 5, a basic objective 6, a semi-transparent mirror 7, a photographic film camera 8, a television camera tube 9, with a beam deflection coil 10, and a television monitor 11. Besides the terrestrial magnetic field, other magnetic fields which may disturb the electron-optical imaging in the X-ray image intensifier tube 5 include magntic fields caused by the high voltage power supply 2, the deflection coils 10 of the camera tube 9, deflection coils of the monitor 11, and magnetic braking devices (not shown) which are often included in the patient table or stand forming part of the device.

The X-ray image intensifier tube 5 comprises an entrance screen 12 with (not separately shown) an X-ray phosphor screen which is provided on the inner side and which is preferably made of CsJ, and a photocathode. Tube 5 further comprises an exit screen 13 which is provided on the inner side of an exit window 14, and one or more intermediate electrodes 15. The operation, an incident radiation beam 16 irradiates the patient 4 and a transmitted, image-carrying X-ray beam 17 is incident on the entrance screen of the intensifier tube. The X-ray beam 17 incident on the entrance screen is converted into a beam of photoelectrons 18 which is accelerated to, for example, 25 kV and which is displayed on the exit screen 13. Through the exit window 14, an image-carrying light beam 19 is emitted by means of which, as desired, a photographic plate can be exposed or a television image can be formed.

The part of the total path of the image-carrying beam which is susceptible to magnetic deflection fields is that part which is situated inside the image intensifier tube, because the image carriers are formed by electrons in this area. In the vicinity of the entrance screen, where the electrons have only a comparatively low velocity, a magnetic field is apt to have a particularly large effect on the direction of the electrons and hence on the image formation. In accordance with the invention, between the patient and the image intensifier tube (i.e. in front of the entrance screen) there is therefore arranged a stray radiation grid 20. In this grid, X-rays whose propagation direction excessively deviates from the propagation direction of the beam 17, for example, due to dispersion inside the patient, are intercepted. A stray radiation grid of this kind, therefore, preferably consists of laminations of a comparatively heavy element such as lead. A single grid comprises laminations having a thickness of, for example, 50 μm which are arranged at a distance of, for example, 250 μm from each other.

The function, other than the magnetic shielding function, or the shape of the grid is not relevant to the present invention and any grid normally used in these systems can be used. Such a grid may be, for example, a series of transverse slits. Use can also be made of cross-hatched grids which are formed , for example, by arranging two single grids one behind the other, rotated through 90°.

In accordance with the invention, at least a part of the material of the stray radiation grid is ferromagnetic material, such as, for example, mu-metal. This ferromagnetic material may replace all of the normally used grid material. Laminations of the grid may also be stacked, for example, in an alternating manner or in a sequence with fewer ferromagnetic laminations than heavy metal laminations. Alternatively, each of the laminations can be partly made of a heavy material and partly of a ferromagnetic material. In the latter case, a double-layer form as well as an alloy of heavy metal and ferromagnetic material can be used. Alloys for this purpose can be formed, for example, by the sintering of powder of both metals in a mixing ratio which can be chosen at random, the molten mass being quickly cooled, for example, in the form of a foil. Alloys are thus obtained which are sometimes also referred to as amorphous metals.

According to the state of the art, use is made of a foil of mu-metal, having a thickness of from 10 to 70 μm, which is arranged in front of the entrance screen of the image intensifier tube. Calculations performed on known X-ray image intensifier tubes reveal that a mu-metal foil thickness of approximately 50 μm represents a reasonable compromise between the degree of magnetic shielding and the degree of radiation absorption and dispersion, but the magnetic shielding is certainly not optimum. In a device according to the invention, a thickness equivalent of, for example, 300 μm mu-metal can be readily realized without substantial absorption or dispersion of the image forming X-ray beam occurring.

In the described embodiment, a suitable magnetic contact is preferably ensured between the stray radiation grid according to the invention and a magnetic shielding jacket 21 made of a ferromagnetic material, which is usually arranged around the image intensifier tube. To this end, the jacket 21 may be slightly extended on the front side of tube 5, the stray radiation grid being attached thereto. Normally, on the exit side of the tube the magnetic jacket 21 of the image intensifier tube extends as far as possible towards the exit window 14 or possibly to the basic objective 6. The penetration of disturbing magnetic fields through the exit window is thus usually sufficiently prevented.

The described embodiment is an X-ray examining device in which an existing stray radiation grid is replaced by a grid according to the invention. Another possibility is that a grid according to the invention may be added to a device which already includes a stray radiation grid or to a device which does not. If a single stray radiation grid is present, preferably the second grid is arranged at an angle of 90° with respect thereto.

A preferred position for the shielding grid is as near as possible to the entrance screen of the image intensifier tube. In devices in which a stray radiation grid is arranged in a position in front of the image intensifier tube, for example, in order to enable large pictures to be made, the stray radiation grid is then mounted at a comparatively long distance from the image intensifier tube and the use of an additional grid as a magnetic shielding grid will be advantageous. When a magnetic shielding grid according to the invention is used in a device where the image intensifier tube is not provided with a ferromagnetic jacket, the grid is preferably provided with a flange of ferromagnetic material which extends rearwards around at least a part of the image intensifier tube.

In a preferred embodiment of a magnetic screening grid according to the invention, the laminations are made of a strip-like core of ferromagnetic material which is either sandwiched between or totally covered by layers. Preferably, a tin-lead solder is used as the heavy metal.

Besides applications in X-ray examining devices, the device can also be successfully used in, for example, a gamma camera in which an image intensifier tube is used for the recording of scintillations occurring. A gamma camera includes a stray radiation grid in the form of a collimator. An adapted shielding grid according to the invention can be added to this collimator, or ferromagnetic material can be included in the collimator.

A substantial improvement of the image formation can be achieved in infrared viewers including a light intensifier tube by the use of a shielding grid according to the invention. Stray radiation grids are often absent from these viewers, due to the complete absorption of infrared radiation by foils of ferromagnetic material. A shielding grid according to the invention, adapted to the resolution of the entrance screen, represents a favorable solution in this case. If this shielding is not used, the terrestrail magnetic field has a strongly disturbing effect, due to the frequency changing orientation of the device during measuring.

In some modern image intensifier tubes, notably light intensifier tubes, the electron-optical system includes a channel amplifier plate. Because an image-carrying electron beam also occurs therein, use can effectively be made of a magnetic shielding according to the invention by including ferromagnetic material in the channel amplifier plate or by making the channel plate at least partly of ferromagnetic material.

What is claimed is:

1. An image-forming device, comprising an image intensifier tube having an entrance screen, an exit screen and sides connecting the two screens, which tube includes a magnetic shielding material constructed in a grid configuration, said material being located in front of the entrance screen.

2. An image-forming device as claimed in claim 1, wherein the shielding grid is a stray radiation grid in which ferromagnetic material is included.

3. An image-forming device as claimed in claim 2, wherein the shielding grid comprises laminations of ferromagnetic material and laminations of radiation-transparent material.

4. An image-forming device as claimed in claim 3, wherein the shielding grid further comprises radiation absorbing laminations.

5. An image-forming device as claimed in claim 2, wherein the shielding grid comprises multi-layer laminations of ferromagnetic material and radiation absorbing material.

6. An image-forming device as claimed in claim 2, wherein the shielding grid includes mixtures of radiation absorbing material and ferromagnetic material.

7. An image-forming device comprising:

an image intensifier tube, having an entrance screen, an exit screen and sides connecting the two screens; and a magnetic shielding material, constructed in a grid configuration, said material being located in front of the entrance screen.

8. An image-forming device as claimed in claim 7, wherein the shielding grid is a stray radiation grid in which ferromagnetic material is included.

9. An image-forming device as claimed in claim 8, wherein the shielding grid comprises laminations of ferromagnetic material and laminations of radiation-transparent material.

10. An image-forming device as claimed in claim 9, wherein the shielding grid further comprises radiation absorbing laminations.

11. An image-forming device as claimed in claim 8, wherein the shielding grid comprises multi-layer laminations of ferromagnetic material and radiation absorbing material.

12. An image-forming device as claimed in claim 8 wherein the shielding grid includes mixtures of radiation absorbing material and ferromagnetic material.

13. An image-forming device as claimed in claim 6 or 12 further comprising a magnetic shielding jacket surrounding the sides of the image intensifier tube;

wherein the shielding grid is in magnetic contact with the shielding jacket, such that the shielding grid and the shielding jacket form a magnetically closed sleeve around the entrance screen of the image intensifier tube.

14. An image-forming device as claimed in claim 6 or 12 further comprising:

an x-ray source; and wherein the image intensifier tube comprises an x-ray image intensifier tube.

15. An image-forming device as claimed in claim 6 or 12 wherein the image intensifier tube is a gamma camera.

16. An image-forming device as claimed in claim 6 or 12 wherein the image intensifier tube comprises a light intensifier tube.

17. An image-forming device as claimed in claim 6 or 12 wherein the image-forming device is an infra-red viewer.

18. A magnetic shielding element, comprising laminations of radiation transparent material and laminations of ferromagnetic material, said materials constructed in a grid configuration, whereby substantial magnetic shielding is obtained without substantial absorption or dispersion of incident radiation.

* * * * *